US010030377B1

(12) United States Patent
Boeltl

(10) Patent No.: US 10,030,377 B1
(45) Date of Patent: Jul. 24, 2018

(54) REFILL AND WASH DOWN ASSEMBLY, AND TOILET

(71) Applicant: Acorn Engineering Company, Industry, CA (US)

(72) Inventor: Darryl M. Boeltl, Whittier, CA (US)

(73) Assignee: Acorn Engineering Company, City of Industry, CA (US)

( * ) Notice: Subject to any disclaimer, the term of this patent is extended or adjusted under 35 U.S.C. 154(b) by 0 days.

(21) Appl. No.: 15/686,616

(22) Filed: Aug. 25, 2017

(51) Int. Cl.
*E03D 11/08* (2006.01)
*E03F 1/00* (2006.01)
*A47K 13/30* (2006.01)

(52) U.S. Cl.
CPC ..... *E03D 11/08* (2013.01); *A47K 13/30* (2013.01); *E03F 1/006* (2013.01)

(58) Field of Classification Search
CPC ..... E03D 11/08; A47K 13/30; E03F 1/006
USPC ..... 4/431
See application file for complete search history.

(56) References Cited

U.S. PATENT DOCUMENTS 1,107,515 A * 8/1914 Haas ..... E03D 11/02 4/420
1,142,249 A * 6/1915 Griffiths ..... E03D 11/13 4/420
4,041,554 A 8/1977 Gregory et al.
4,710,987 A 12/1987 Mesun et al.
5,109,551 A 5/1992 Lecat
5,692,250 A * 12/1997 Oldfelt ..... E03D 5/00 4/224
6,397,405 B1 * 6/2002 Grech ..... E03D 3/00 4/420
6,467,101 B1 * 10/2002 Artola ..... E03D 3/10 4/213
6,687,922 B1 2/2004 Marshall et al.
2006/0288472 A1 12/2006 Pondelick
2009/0320199 A1 12/2009 Stauder
2010/0154107 A1 6/2010 Wu
2011/0131717 A1 6/2011 Beale

* cited by examiner

*Primary Examiner* — Huyen Le
(74) *Attorney, Agent, or Firm* — Eric J. Sosenko; Jonathan P. O'Brien; Honigman Miller Schwartz and Cohn LLP

(57) ABSTRACT

A refill and wash down assembly for a vacuum toilet. The refill and wash down assembly includes a manifold having a left side, a right side and an inlet configured to be connected to a water source, a slot defined through the manifold and extending from the left side to the right side. The manifold further includes a plurality of left side ports defined on the left side and a plurality of right side ports defined on the right side. A first array of refill tubes extends from the ports on the right side of the manifold and a second array of refill tubes extends from the ports on the left side of the manifold. Each refill tube also has a nozzle on its distal end and is of a different length different than the other refill tubes in the same array.

25 Claims, 6 Drawing Sheets

REFILL AND WASH DOWN ASSEMBLY, AND TOILET

BACKGROUND OF THE INVENTION

Field of the Invention

This invention relates to waste receptacles that are open at the top and which include a suction-type discharge. More specifically, the invention relates to a vacuum toilet system.

Description of Related Technology

Vacuum toilet systems are known in the art. An important advantage of vacuum toilet systems is found in the comparatively low water consumption requirements.

In a vacuum toilet system, provisions are made for supplying water to the toilet bowl, while a sewage pipe and collection vessel are maintained under a partial vacuum. By opening a valve in the sewage pipe, atmospheric pressure is allowed to forcefully move the wastewater into the collection vessel. In conventional vacuum toilets, the bowl inner surfaces are washed and the pool of water or sump at the bottom of the toilet is refilled by flushing the inner surfaces with refill water from orifices distributed about the circumference of the upper opening of the toilet bowl.

One disadvantage of known vacuum toilet bowls is inadequate washing of the bowl's inner surfaces by the refill water. Attempts to overcome this disadvantage have involved increasing the amount of refill water used, which counterproductively reduces the water saving advantage of the vacuum toilet systems.

The foregoing examples of the related art and limitations therewith are intended to be illustrative and not exclusive. Other limitations of the related art will become apparent to those of skill in the art upon a reading of the present specification and a study of the accompanying drawings.

SUMMARY OF THE INVENTION

In view of the limitations and drawbacks of the know prior art, as generally described above, the disclosed embodiments incorporating the principles of the present invention achieve the goal of complete cleaning of the inner bowl surfaces, while maintaining the low water consumption requirements of vacuum toilets.

Notwithstanding the above, the foregoing examples of the related art and limitations related therewith are intended to be illustrative and not exclusive. Other limitations of the related art will become apparent to those of skill in the art upon a reading of the specification and a study of the drawings.

In accordance with an aspect of the present invention, provided is a refill and wash down assembly for a vacuum toilet. The refill and wash down assembly includes a manifold having a left side, a right side and an inlet connected to a water source. The manifold also includes a slot extending from the left side to the right side, and array of a multiplicity of ports in a line on the left side, and an array of an equal number of ports in a line on the right side. A first array of refill tubes, each with a length differing from the others in the array, is provided in which each tube is connected at a proximal end to a port on the left side of the manifold and is provided at a distal end with a nozzle. A second array of refill tubes, each having a length differing from others in the array, is provided in which each tube is connected at a proximal end to a port on the right side of the manifold and is provided at a distal end with a nozzle.

In another aspect, a vacuum toilet is provided having a toilet bowl with an open top, an inner surface, a sewage port at the bottom of the bowl, a vacuum sewage line attached to the sewage port, the sewage line including a valve, and a pool of water at the bottom of the bowl when the sewage line valve is closed, the pool of water capable of entering the sewage line when the valve is open. A toilet seat is located at the top of the toilet bowl, the seat having a topside and an underside. A refill and wash down assembly is attached to the underside of the seat. A flush mechanism is included that is capable of delivering a predetermined volume of water to the refill and wash down assembly when activated, the refill and wash down assembly is also capable of delivering a stream of water to substantially all portions of the inner surface of the bowl below the refill and wash down assembly when the flush mechanism is activated. The refill and wash down assembly is also capable of refilling the pool of water at the bottom of the bowl when the flush mechanism is activated.

The following embodiments and aspects thereof are described and illustrated in conjunction with systems, tool and methods which are meant to be exemplary and illustrative, not limiting in scope. In various embodiments, one or more of the above-described problems have been reduced or eliminated, while other embodiments are directed to other improvements.

In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

DETAILED DESCRIPTION OF THE INVENTION

Figure 1:
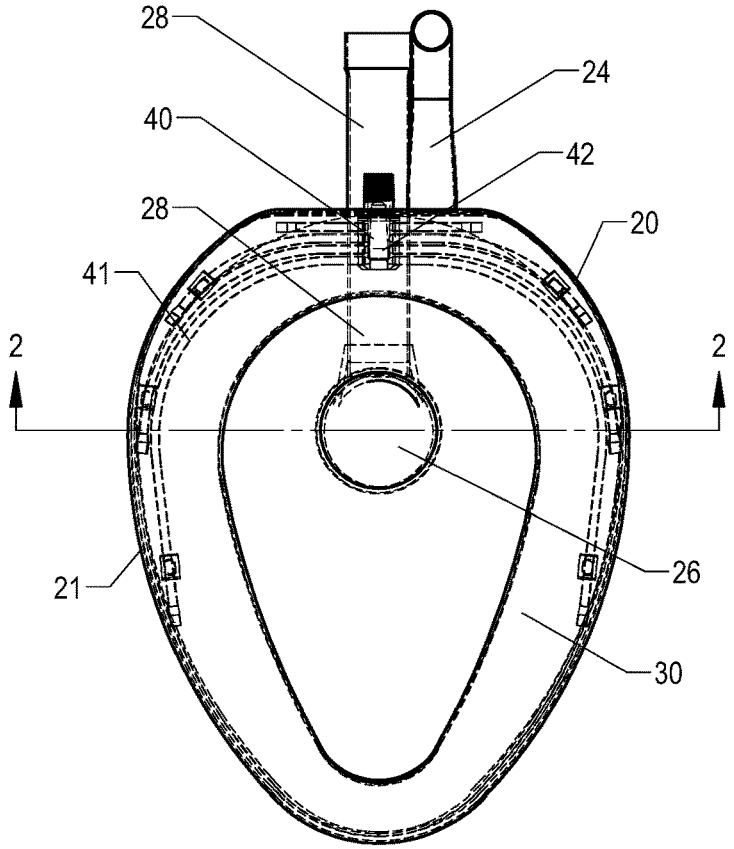
FIG. 1 is a top plan view of a toilet embodying the principles of the present invention.

Referring now to the drawings, seen in FIG. 1 is a top plan view of vacuum toilet 20 embodying the principles of the present invention. The same vacuum toilet 20 is illustrated in exploded view in FIG. 16. Visible in FIGS. 1 and 16, it is seen that the vacuum toilet 20 includes with toilet seat 30, open top 22 of toilet bowl 21, wastewater port 26, and vent tube assembly 24. A refill and wash down assembly 40 is also provided that includes a manifold 42 and a multiplicity of refill and wash down tubes 41, which are depicted in dashed lines and located on the underside of the toilet seat 30. Also depicted is the sewage line 28. A normally closed valve in the sewage line is opened only when the vacuum toilet 20 is flushed.

Figure 2:
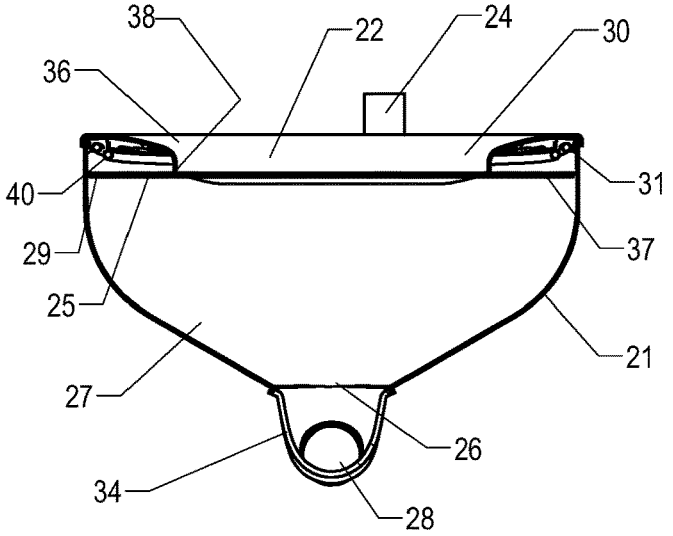
FIG. 2 is a cross-sectional view of the toilet seen in FIG. 1, generally taken along line 2-2.

FIG. 2 is a cross-sectional view of the vacuum toilet of FIG. 1, generally taken at line 2-2. Visible in FIG. 2 is the toilet bowl 21, with a bowl inner surface 27 and open top 22. The wastewater port 26 is at the bottom of the bowl 21, with a waste elbow 34 connecting the port 26 to the sewage line. The toilet seat 30 has a topside 36 and an underside 37 and is welded about the circumference of the open top 22 of the toilet bowl 21. The refill and wash down assembly 40 is connected to the underside 37 of the toilet seat 30, as seen in FIG. 16.

Figure 16:
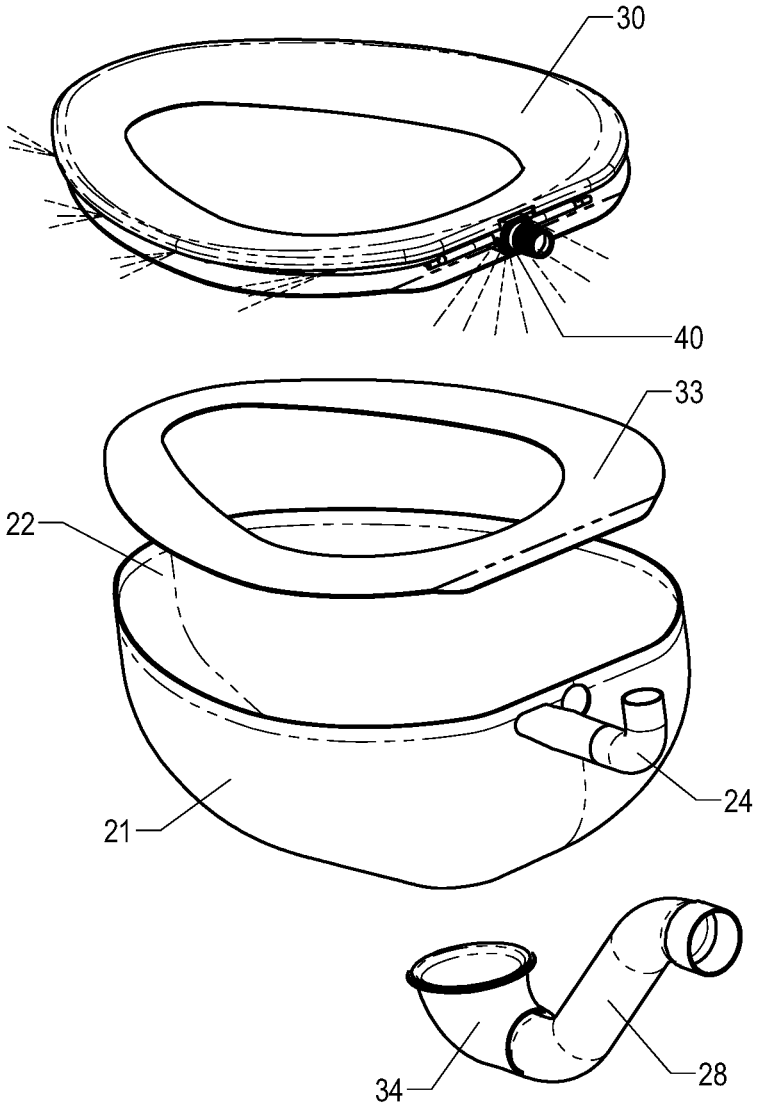
FIG. 16 is an exploded view of a vacuum toilet seen in FIG. 1.

Also visible in FIGS. 2 and 16 is a flushing rim 25 and vent tube assembly 24. At its inboard side, the flushing rim 25 is connected to an inner rim 38 of the toilet seat 30. A gap 29 extends from the edge of the flushing rim 25 to the refill and wash down assembly 40. The flushing rim 25 prevents access to and vandalism of the refill and wash down assembly 40. The gap 29 also allows water from the refill and wash down assembly 40 to stream onto and wash down the bowl inner surface 27.

Figure 14:
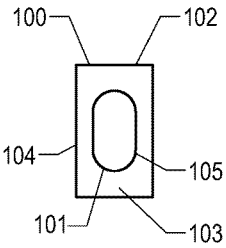
FIG. 14 is a top view of bracket utilized in connection with the present invention before bending.
Figure 15:
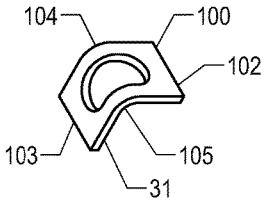
FIG. 15 is a perspective view of the bracket of FIG. 14 after bending.

In the illustrated embodiment, the refill and wash down assembly 40 is welded to mounting brackets 31, which in turn are welded to the underside 37 of the toilet seat 30. FIGS. 14 and 15 illustrate details of the brackets and are further discussed below. The flushing rim 25 is welded to the inner rim 38 of the toilet seat 30, the toilet seat 30 is welded to the bowl 21, and the waste elbow 34 is welded to the bowl 21 at the wastewater port 26.

Figure 3:
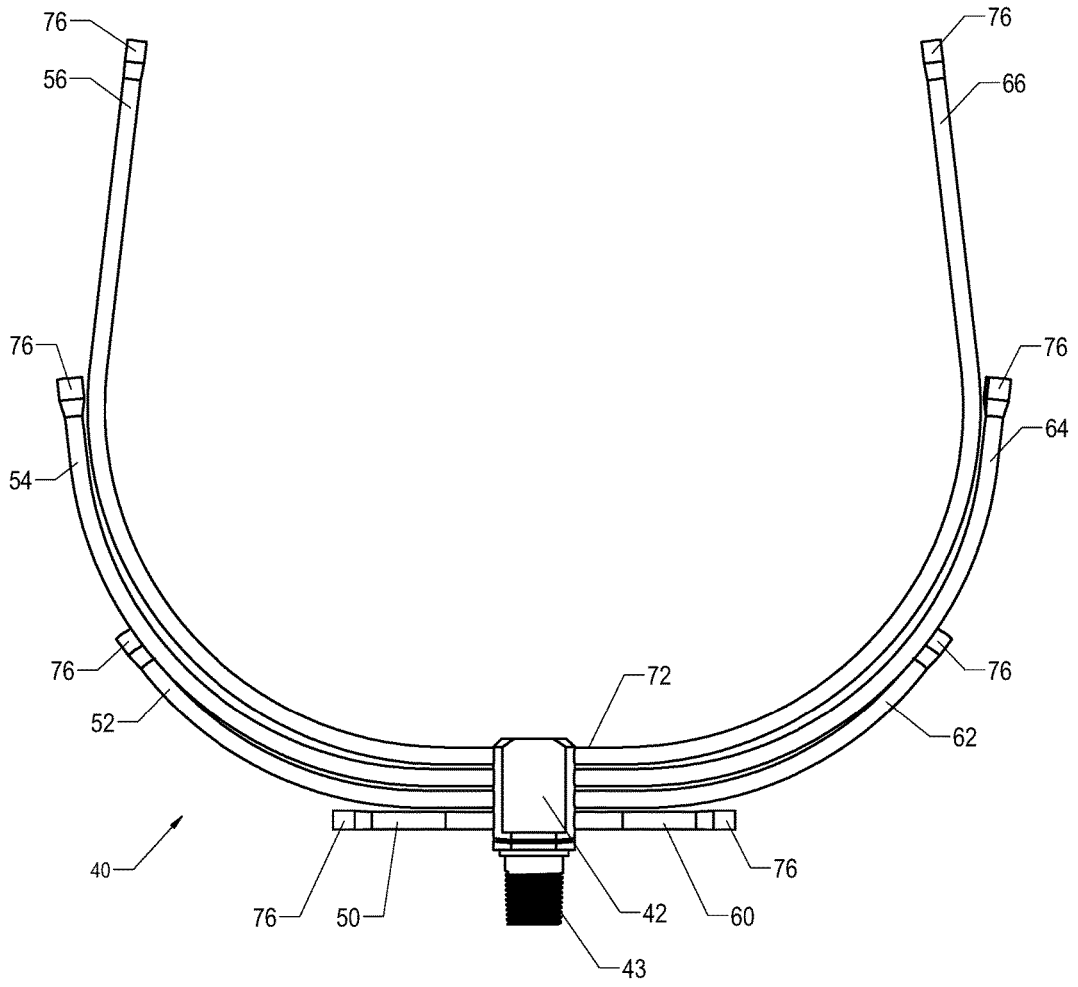
FIG. 3 is a top plan view of a refill tube utilized in conjunction with the toilet seen in FIG. 1.

FIG. 3 is a top plan view of the refill and wash down assembly 40. In the assembly 40, all of the refill tubes are identical except for lengths and curvatures. In embodiments, there are four lengths of refill tubes. For convenience, the shortest refill tubes are termed "A", the next longer "B", the next longer "C", and the longest refill tubes termed "D". The refill tubes are connected to the left side and right side ports of the manifold 42 (see FIGS. 4-6 for details). All of the tubes are connected to the manifold 42 at their proximal ends (for example, proximal end 72 of right D tube 66 in FIG. 3) and all of the refill tubes have a crimp nozzle 76 at their distal ends (for example, nozzle 76 at distal end 74 of right D tube 66 in FIG. 3). Details of the crimp nozzle 76 are seen in FIG. 7.

In FIG. 3, the refill tubes are shown as follows: left A tube 50, with crimp nozzle 76; right A tube 60 with crimp nozzle 76; left B tube 52 with crimp nozzle 76; right B tube 62 with crimp nozzle 76; left C tube 54 with crimp nozzle 76; right C tube 64 with crimp nozzle 76; left D tube 56 with crimp nozzle 76; and right D tube 66 with crimp nozzle 76.

Figure 4:
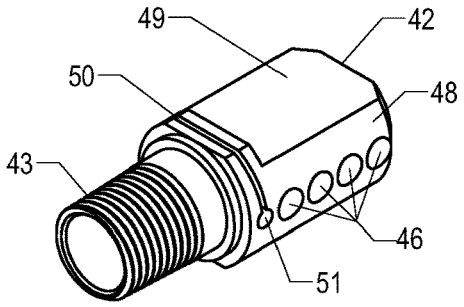
FIG. 4 is an upside down perspective view of a manifold utilized in conjunction with the refill tube seen in FIG. 3.

FIG. 4 is a perspective view of the bottom side of the manifold 42 into which the proximal ends of the refill tubes are received. Visible in FIG. 4 is the manifold's inlet 43, bottom side 49, left side 48, and four left side ports 46. Also visible is the slot 50. The slot 50 extends across the bottom, left and right sides, and terminates on each end in an orifice, of which left side orifice 51 is visible in FIG. 4.

Figure 5:
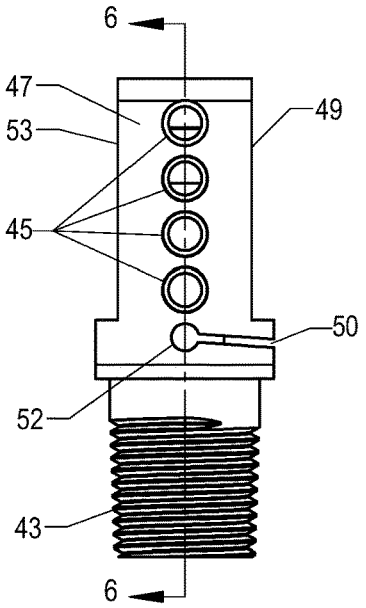
FIG. 5 is a right side view of the manifold seen in FIG. 4.

FIG. 5 is a right side view of the manifold 42. Seen in FIG. 5 is the bottom side 49, an upper side 53, a right side 47, four right side ports 45, and the slot 50 which terminates in a right side orifice 52.

Figure 6:
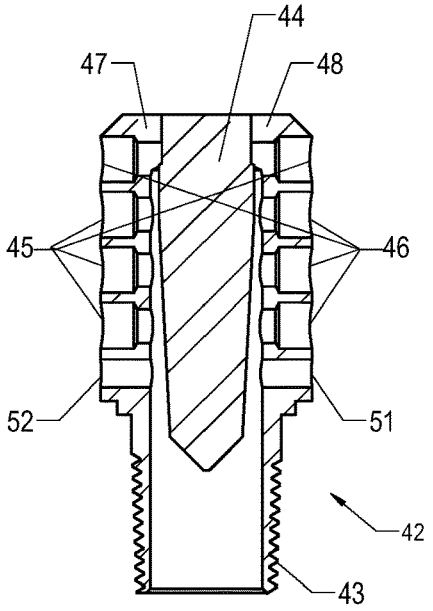
FIG. 6 is a cross section view of the manifold generally taken at line 6-6 of FIG. 3.
Figure 7:
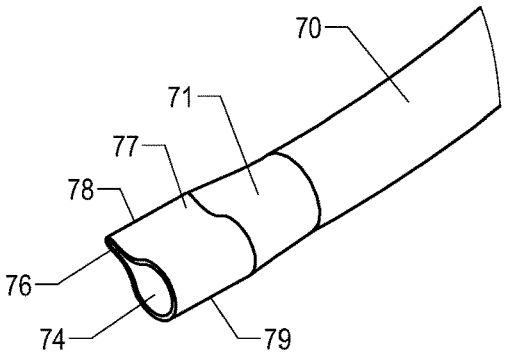
FIG. 7 is a perspective view of a distal end of a refill tube showing the nozzle.

FIG. 6 is a cross section view of the embodiment manifold 42 generally taken at line 6-6 of FIG. 5. Visible in FIG. 6 is the manifold inlet 43, a manifold plug 44 in the center of the manifold 42, an array of the four right side manifold ports 45 on the right side 47 of the manifold 42, and an array of the four left side manifold ports 46 on the left side 48 of the manifold 42. Also visible are the right and left orifice 52, which are coupled to the slot 50 (not seen in FIG. 6). The manifold plug 44 is tapered so as to deliver the same amount of water to ports 45, 46 and, therefore, to each of the refill tubes.

FIG. 7 is a perspective view of a representative refill tube 70, showing the nozzle 76. The refill tube 70 seen in FIG. 7 is representative of all refill tube embodiments. The refill tube 70 is circular in cross-section. The crimp nozzle 76 has a crimped side 78 and a curved side 79. The crimp nozzle 76 is formed by crimping the distal end 74 of the refill tube 70 forming a crimp zone 77 and the crimped opening of the crimp nozzle 76. A transition zone 71 is formed between the circular cross-section of the refill tube 70 and the crimp zone 77. In use, the crimped side 78 is provided on the inner side of the refill and wash down assembly 40, generally toward the axis defined by the manifold 42, as seen in FIG. 3. In various embodiments, the crimp zone 77 is approximately 0.250 to approximately 0.313 inches in length and the opening of the crimp nozzle 76 is approximately 0.5 inch from the crimped side to the curved side.

Figure 8:
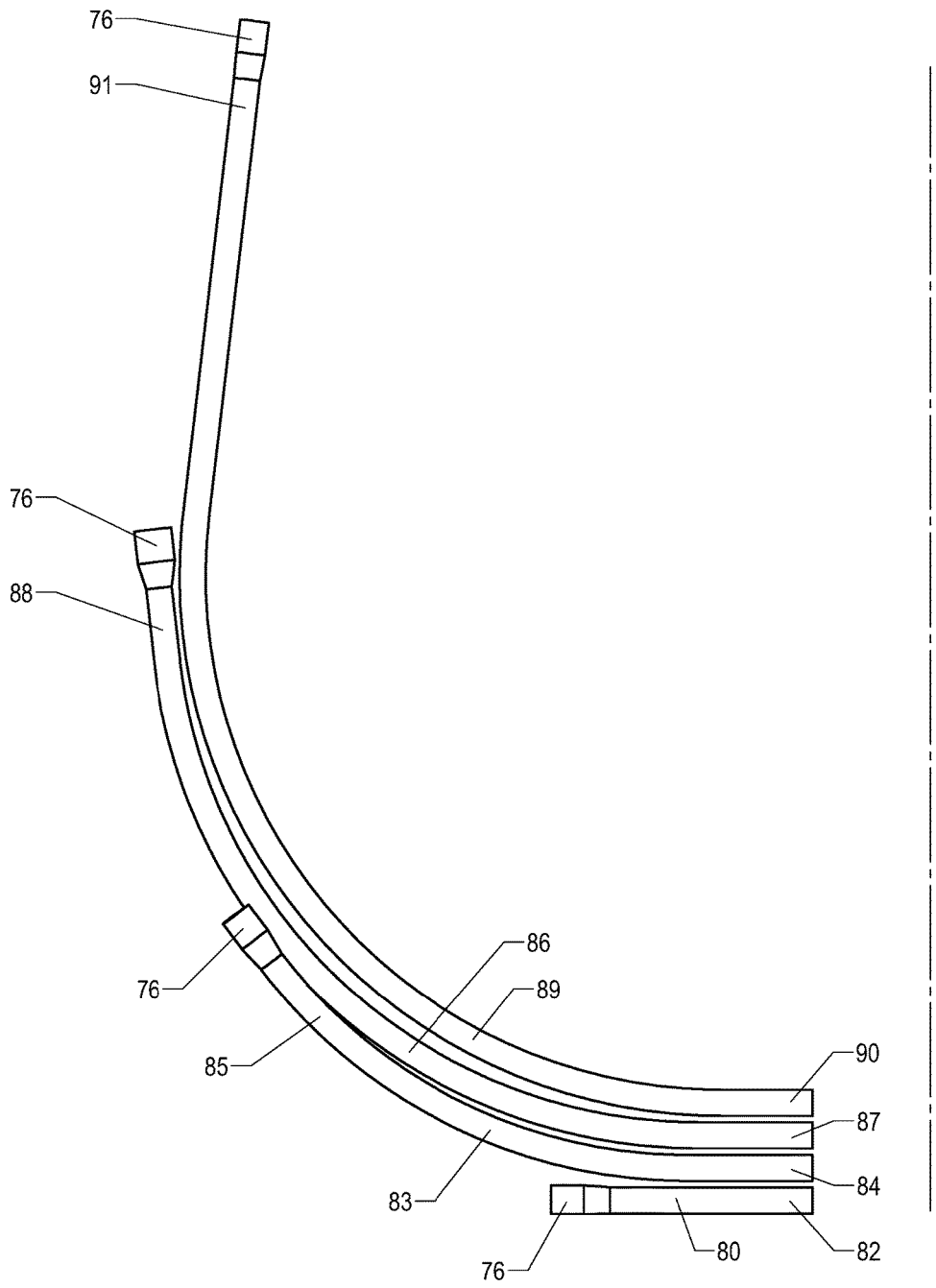
FIG. 8 is an enlarged top plan view of the refill tubes on the left hand side of FIG. 3.

FIG. 8 is a top plan view of representative refill tubes A, B, C, and D. In embodiments, the A tube 80 is straight with a length of approximately 2½ inches and has a crimp nozzle 76 on its distal end opposite of its proximate end 82. The B tube 83 has a length of approximately 5¾ inches and at its proximal end 84 is straight for approximately 1¼ inches. The B tub 83 is then curved with a radius of curvature of approximately 4⅞ inches and has a crimp nozzle 76 on its distal end 85. The C tube 86 has a length of approximately 9¼ inches and its proximal end 87 is straight for approximately 1 inch, the C tube 86 is then curved with a radius of curvature of approximately 4⅞ inches, followed by a straight portion of approximately 1¼ inches and has a crimp nozzle 76 on its distal end 88. The distal end of the C tube is approximately 5⅛ inches from a line drawn perpendicular to the straight portion of the proximal end 87 of the C tube at the proximal end. The D tube 89 has a length of approximately 13⅛ inches and at its proximal end is straight for approximately ¾ of an inch, the D tube 89 then is curved with a radius of a curvature of approximately 4⅞ inches, followed by a straight portion of approximately 4¾ inches and has a crimp nozzle 76 on its distal end 91. The distal end of the D tube is approximately 5⅜ inches from a line drawn perpendicular to the straight portion of the proximal end 90 of the D tube at the proximal end 90. Each of the refill tubes A, B, C, D have an out diameter of approximately ¼ inch with a wall thickness of approximately 0.02 inches.

Figure 9:
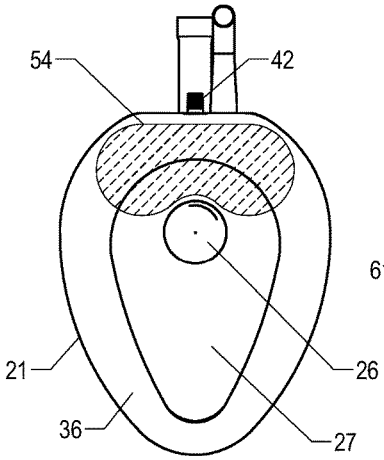
FIG. 9 is a schematic top view of a toilet bowl incorporating the principles of the present invention and showing the spray pattern associated with the slot and its associated orifices.

FIG. 9 is a schematic top view of the toilet 20 showing a spray pattern 54 on the inside surface 27 of the toilet bowl 21. Spray pattern 54 is associated with the manifold slot 50 and the side orifices 51, 52 connected thereto. The manifold 42 is generally shown in FIG. 9, but the manifold slot 50 and the side orifices 51, 52 are not shown. (See FIGS. 4-6 for the manifold slot 50 and the side orifices 51 and 52.) Also seen in FIG. 9 is the toilet seat 36, wastewater port 26, and toilet bowl 21. The elements shown in FIGS. 10-13 are generally the same as those seen in FIG. 9. Although FIGS. 10-13 show only the spray patterns 61, 63, 65, 67 associated with the right A refill tube 60, right B refill tube 62, right C refill tube 64, and right D refill tube 66, respectively, it will be understood that a mirror image of spray patterns are associated with the left A, B, C, and D tubes.

Figure 10:
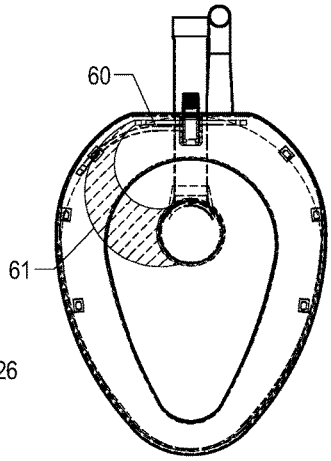
FIG. 10 is a schematic top view of a toilet bowl incorporating the principles of the present invention and showing the spray pattern associated with one of the spray tubes.
Figure 11:
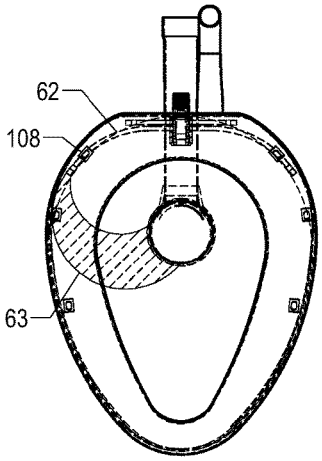
FIG. 11 is a schematic top view of a toilet bowl incorporating the principles of the present invention and showing the spray pattern associated with another one of the spray tubes.
Figure 12:
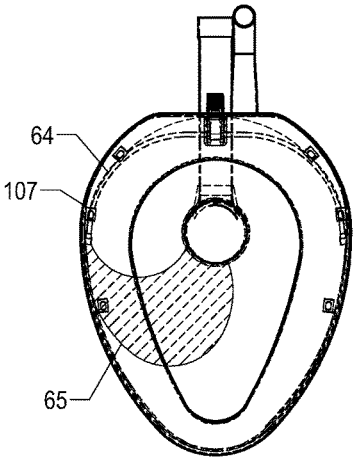
FIG. 12 is a schematic top view of a toilet bowl incorporating the principles of the present invention and showing the spray pattern associated with another one of the spray tubes.
Figure 13:
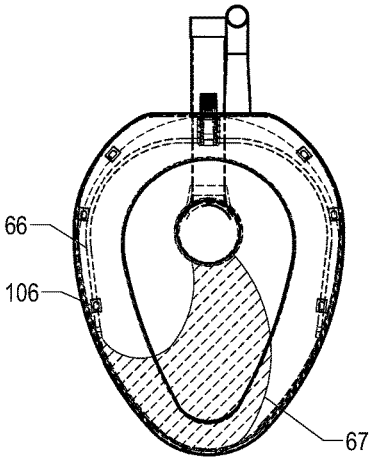
FIG. 13 is a schematic top view of a toilet bowl incorporating the principles of the present invention and showing the spray pattern associated with another one of the spray tubes.

Accordingly, FIG. 10 is a schematic top view of the toilet 20 showing the right A refill tube 60 and the associated spray pattern 61; FIG. 11 is a schematic top view of the toilet 20 showing the right B refill tube 62, its bracket 108, and the associated spray patterns 63; FIG. 12 is a schematic top view of the toilet 20 showing the right C refill tube 64, its bracket 107, and the associated spray pattern 65; and FIG. 13 is a schematic top view of the toilet 20 showing the right D refill tube 66, its bracket 106 and the associated spray pattern 67. The refill tubes 50, 52, 54, 56 of the left side of the refill and wash down assembly 40 each define a similar, but opposite spray pattern on the inside surface 27 of the toilet bowl 21. As a result, all of the spray patterns, including the spray patterns defined by the refill tubes, the slot 50 and side openings 51, 52, cooperate to define a composite spray pattern substantially covering the entire inner surface 27 of the toilet bowl 21 below the refill and wash down assembly 40.

An approximately equally amount of water is emitted from each of the refill tubes and from the slot and side orifices when the vacuum toilet 20 is flushed. As shown in FIGS. 9-13, and in conjunction with the left refill tubes not shown in FIGS. 10-14, the refill tubes and the slot are oriented so that substantially the entire inner surface 27 of the toilet bowl 21 below the refill and wash down assembly 40 is covered and washed by the combined spray patterns. Once the valve in the toilet line is closed, any further sprayed water accumulates at the wastewater port 26 at the lowest portion of the toilet bowl 21 and forms the pool of water which receives waste on next use of the toilet 20. The valve in the sewage line is normally closed and opens only when the vacuum toilet is flushed.

FIG. 14 is a top view of the mounting bracket 31, seen in FIG. 15, before bending. As seen in FIG. 14, the mounting bracket 31 is originally provided as a flat bracket 100 comprised of a rectangular piece of metal with an oval hole 101 cut in it, forming the bracket front side 102, rear side 103, left side 104 and right side 105. The flat bracket 100 is bend downward bring the front side 102 and rear side 103 closer together and forming arches of the left side 104 and right side 105. In use, either the front side 102 or the rear side 103 is welded to the underside of the toilet seat 37. A tube is then placed between the left side 104 and right side 105, and the tube is welded to either the left side 104 or the right side 105 of the bracket 31.

The vacuum toilet 20 may be manufactured of any suitable hard, strong, impervious material, such as iron, steel, stainless steel and porcelain. In a preferred embodiment, the vacuum toilet 20 is manufactured of stainless steel. It is also preferred that the refill and wash down assembly 40 is manufactured of stainless steel.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope. The applicant or applicants have attempted to disclose all the embodiments of the invention that could be reasonably foreseen. There may be unforeseeable insubstantial modifications that remain as equivalents.

I claim:

1. A refill and wash down assembly for a vacuum toilet, the refill and wash down assembly comprising:

a manifold having a left side, a right side and an inlet configured to be connected to a water source, an opening defined through the manifold and extending from the left side to the right side, the manifold further including a plurality of left side ports defined on the left side and a plurality of right side ports defined on the right side;

a first array of refill tubes extending from the manifold, each refill tube of the first array being connected at a proximal end to one of the left side ports, each refill tube of the first array also having a nozzle on a distal end and having a length different from the other refill tubes of the first array; and a second array of refill tubes extending from the manifold, each refill tube of the second array being connected at a proximal end to one of the right side ports, each refill tube of the second array having a nozzle on a distal end and having a length different from the other refill tubes of the second array.

2. The refill and wash down assembly of claim 1, wherein each of the first and second arrays of refill tubes includes at least three refill tubes.

3. The refill and wash down assembly of claim 1, wherein the manifold is configured to deliver a common volume of water to each port of the first and second arrays and to the slot.

4. The refill and wash down assembly of claim 1, wherein each of the first and second arrays of refill tubes includes at least one refill tube having a curved portion.

5. The refill and wash down assembly of claim 1, wherein each of the first and second arrays of refill tubes includes a plurality of refill tubes having a curved portion.

6. The refill and wash down assembly of claim 1, wherein each of the first and second arrays of refill tubes includes at least one refill tube having a straight portion.

7. The refill and wash down assembly of claim 1, wherein each of the first and second arrays of refill tubes includes at least one refill tube that is straight.

8. The refill and wash down assembly of claim 1, wherein at least one refill tube of the first array has a length equal to at least one refill tube of the second array.

9. The refill and wash down assembly of claim 1, wherein at least one of the refill tubes in the first and second arrays have a length in the range of about 2½ inches to 13⅛ inches.

10. The refill and wash down assembly of claim 1, wherein the nozzle is a formed part of the distal end of the refill tube.

11. The refill and wash down assembly of claim 1, wherein the nozzle is a crimp nozzle having a crimped side and a curved side.

12. The refill and wash down assembly of claim 11, wherein the crimped side of the nozzle is on an inboard side of the array.

13. The refill and wash down assembly of claim 1, wherein the opening is a slot.

14. A vacuum toilet comprising:

a toilet bowl having an open top, an inner surface, a sewage port at the bottom of the bowl, a vacuum sewage line attached to the sewage port and configured to be coupled to a vacuum source;

a toilet seat positioned adjacent the open top of the toilet bowl, the toilet seat having a topside and an underside;

a refill and wash down assembly positioned between the toilet bowl and the toilet seat, the refill and wash down assembly comprising a manifold having a left side, a right side and an inlet configured to be connected to a water source, an opening defined through the manifold and extending from the left side to the right side, the manifold further including a plurality of left side ports defined on the left side and a plurality of right side ports defined on the right side;

a first array of refill tubes extending from the manifold, each refill tube of the first array being connected at a proximal end to one of the left side ports, each refill tube of the first array also having a nozzle on a distal end and having a length different from the other refill tubes of the first array; and a second array of refill tubes extending from the manifold, each refill tube of the second array being connected at a proximal end to one of the right side ports, each refill tube of the second array having a nozzle on a distal end and having a length different from the other refill tubes of the second array; and wherein the slot defines a first spay pattern and each refill tube of the first and second arrays respectfully defines a spray pattern different from the other refill tubes of the first and second arrays, the spray patterns cooperating to define a composite spray pattern covering substantially all portions of the inner surface of the toilet bowl below the refill and wash down assembly.

15. The vacuum toilet of claim 14, wherein the vacuum toilet further comprising a flushing rim, the flushing rim being permanently attached to the underside of the toilet seat along an inboard side thereof.

16. The vacuum toilet of claim 14, wherein the refill and wash down assembly is permanently attached to the underside of the toilet seat.

17. The vacuum toilet of claim 14, wherein the toilet seat is permanently attached to the open top of the bowl.

18. The vacuum toilet of claim 17 wherein the toilet seat is permanently attached to the open top of the bowl along an outer perimeter of the open top of the bowl.

19. The vacuum toilet of claim 14, wherein the left side ports are aligned in a straight row and the right side ports are aligned in a straight row opposite of the left side ports.

20. The vacuum toilet of claim 14, wherein a longest one of the refill tubes of the first and second arrays is positioned most inboard relative to a center of the toilet bowl.

21. The vacuum toilet of claim 20, wherein the refill tubes of the first and second arrays are progressively longer proceeding from a most outboard to most inboard one of the refill tubes.

22. The vacuum toilet of claim 14, wherein each of the first and second arrays of refill tubes includes at least three refill tubes.

23. The vacuum toilet of claim 14, wherein each of the first and second arrays of refill tubes includes at least one refill tube having a curved portion and at least one refill tube having a straight portion.

24. The vacuum toilet of claim 14, wherein the first array of refill tubes is a substantial mirror image the second array of refill tubes.

25. The vacuum toilet of claim 14, wherein each refill tube of the first array has a different length from the other refill tubes of the first array and each refill tube of the second array has a different length from the other refill tubes of the second array.

* * * * *